US009283601B2

(12) United States Patent
Bordignon et al.

(10) Patent No.: US 9,283,601 B2
(45) Date of Patent: Mar. 15, 2016

(54) APPARATUS FOR IN-LINE THERMALLY TREATING SEMI-FINISHED PRODUCTS

(75) Inventors: Giuseppe Bordignon, Bicinicco (IT); Alfredo Poloni, Fogliano Redipuglia (IT); Miroslav Zerajic, Palmanova (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 331 days.

(21) Appl. No.: 14/116,746

(22) PCT Filed: May 11, 2012

(86) PCT No.: PCT/EP2012/058752

§ 371 (c)(1), (2), (4) Date: Nov. 8, 2013

(87) PCT Pub. No.: WO2012/156302

PCT Pub. Date: Nov. 22, 2012

(65) Prior Publication Data

US 2014/0072923 A1 Mar. 13, 2014

(30) Foreign Application Priority Data

May 13, 2011 (IT) ..... MI2011A0848

(51) Int. Cl.
*C21D 1/26* (2006.01)
*B21B 45/02* (2006.01)

(52) U.S. Cl.
CPC ..... *B21B 45/0215* (2013.01); *B21B 45/0224* (2013.01)

(58) Field of Classification Search
USPC ..... 432/225, 250, 247, 128; 266/102, 103, 266/252, 280, 262, 44; 425/79, 376.1; 148/547
See application file for complete search history.

(56) References Cited

U.S. PATENT DOCUMENTS

| | | | | |
|---|---|---|---|---|
| 3,511,483 | A * | 5/1970 | Gentry | F27B 9/32 432/146 |
| 3,877,685 | A * | 4/1975 | Franceschina | C21D 9/085 266/102 |
| 4,541,799 | A * | 9/1985 | Elhaus | F27B 9/20 432/177 |
| 5,551,670 | A * | 9/1996 | Heath | C21D 1/34 266/103 |
| 8,021,598 | B2 * | 9/2011 | Cichocki, Jr. | A61B 17/06066 148/559 |
| 2003/0168787 | A1 * | 9/2003 | Peterson | C01B 31/18 266/252 |
| 2010/0006188 | A1 | 1/2010 | Palfreman et al. | |

FOREIGN PATENT DOCUMENTS

| | | |
|---|---|---|
| EP | 0317785 | 5/1989 |

* cited by examiner

*Primary Examiner* — Gregory A Wilson
(74) *Attorney, Agent, or Firm* — Stetina Brunda Garred & Brucker

(57) ABSTRACT

An apparatus (1) for cooling a bar (10) comprising: —an outer casing (3), —a passageway (2) defining a crossing direction (X) for the bar (10), —at least one drum (4) comprising a plurality of cooling lines (6) each having at least one respective through cavity (9) parallel to the crossing direction (X) and a respective cover (15) which can move between an open position and a closed position, the drum (4) being accommodated in the casing (3) and rotational about a rotation axis (Y) to move the cooling lines (6) between an operating position (11), in which the cavity (9) is aligned with the passageway (2), and at least one resting position (12), in which the cavity (9) is separated from the passageway (2), the casing (3) being shaped so as to touch and hold the respective cover (15) in the closed position when the cooling line (6) is in the resting position (12).

11 Claims, 7 Drawing Sheets

APPARATUS FOR IN-LINE THERMALLY TREATING SEMI-FINISHED PRODUCTS

CROSS REFERENCE TO RELATED APPLICATIONS

The present application claims priority to PCT International Application No. PCT/EP2012/058752 filed on May 11, 2012, which application claims priority to Italian Patent Application No. MI2011A000848 filed May 3, 2011.

STATEMENT RE: FEDERALLY SPONSORED RESEARCH/DEVELOPMENT

Not Applicable.

BACKGROUND

1. Field of the Invention

The present invention relates to an apparatus tot in-line thermally treating metallurgic semi-finished products having extended elongated shape, such as bars, rods, wire rods or other semi-finished products having extended elongated shape.

2. State of the Art

In the technical scope of in-line processes for the production of metallurgic semi-finished products having extended elongated shape, it is known the use of thermal treatment apparatuses, in particular for cooling the semi-finished products, typically arranged downstream of a step of machining by plastic deformation, e.g. rolling. Such apparatuses allow to subject the semi-finished products to a controlled thermal cooling treatment or, more in general to a thermal treatment with a predetermined temperature profile or not directly on the production line, so that the obtained product is immediately marketable at the end of the treatment.

Apparatuses are used for this purpose comprising one or more treatment lines including a plurality of treatment units, aligned and coaxial to one another, provided with a respective through cavity, through which the semi-finished product e.g. a bar, to be treated is passed. In particular, applications are provided in which the apparatus comprises a coding circuit connectable to the through cavities to send a cooling fluid to the semi-finished product, performing a thermal cooling treatment thereon when the semi-finished product passes through the cavities. In this case, the treatment units are also known as coolers.

Typically, the treatment units must be replaced according to the size of the bar to be treated. In order to reduce replacement downtime, during which the line is not operational, and thus to increase productivity, such replacements must occur as quickly as possible, or in all cases in a time compatible with the times required for changing the working cylinders in the rolling mill upstream of the treatment apparatus.

The manual replacement method, characterized by long execution times, is a known treatment unit replacement method. Alternatively, there are automatic or semi-automatic devices with low need of intervention by an operator which allow to save replacement times with respect to entirely manual replacement.

Translating carriage apparatuses on rail are known among the latter. A plurality of cooling units aligned along a direction parallel to the rails are provided an such apparatuses. By translating along the rails, each cooling unit may be taken to operating position so as to be aligned with the direction of advancement of the semi-finished product to be treated.

Such a solution determines a plurality of drawbacks, the main of which are excessive dimensions, poor alignment normally obtainable between cooling units and difficult access to the cooling units due to the linear development of the device.

In order to avoid such drawbacks, a rotating drum apparatus has been developed, being provided with a plurality of cooling lines regularly arranged at constant angular distances along the perimeter region of such a drum. By rotating the dram about its rotation axis, each cooling line may be taken to the operating position so as to align it with the direction of advancement of the bar to be treated. Each cooling line comprises a plurality of cooling units aligned and coaxial to each other, through, which the bar to be treated is susceptible of passing when the cooling line is placed in operating position. However, such an apparatus, described in detail in document EP0317785, is not an optimal solution because it also displays a series of drawbacks.

One drawback is the fact that the rotation axis must also be moveable with respect to the outer casing in which the drum is accommodated in order to guarantee the correct coupling between the cooling circuit and each cooling line when the latter is arranged in operating position. This determines both constructive complications and, once again, a non-optimal, and in all cases improvable, alignment. Furthermore, the cooling units described to EP 0317785 are improvable with regards to maintenance mid cleaning operations, e.g. cleaning of the scale which deposits on the inner walls of the cooling units, and to remove cobbling.

In order to facilitate such maintenance, cleaning and cobbling removal operations, an opening cooling unit has been created, as the one described in U.S. Pat. No. 5,257,511. However, the device in U.S. Pat. No. 5,257,511 does not solve in all the aspects the other products described above. Indeed, in all conditions other than maintenance and cleaning, the covers of the cooling units must be blocked in closed position. The handwheel closing system described in U.S. Pat. No. 5,257,511 although effective with this regard, in all cases determines the need for a manual intervention by the operator, with consequent increase of the time during which the line must remain inactive.

SUMMARY OF THE INVENTION

It is the purpose of the present invention to make available a new in-line thermal treatment apparatus for metallurgic semi-finished products having extended elongated shape which includes a plurality of treatment lines and allows to avoid the drawbacks, maintaining at the same time all the advantages of the mentioned known techniques so as to obtain a considerable redaction of the line change times as the type of semi-finished product varies, consequently increasing productivity and the use factor of the entire production system along which the treatment apparatus is installed.

Another object of the invention is to carry out tally automatic line change operations and to eliminate the manual setting operations at each line change, thus improving the safety conditions of the operators.

A further object of the invention is to guarantee a very accurate alignment of the cooling units of each thermal treatment line and to maintain such an alignment unchanged over time.

Another aspect of the invention is to drastically reduce the time needed for cooling unit cleaning and/or maintenance operations and the time needed for eliminating cobbling and consequently restoring the treatment line.

In accordance with the present invention, such an object is obtained by means of an apparatus for thermally treating a metallurgical semi-finished product having extended elongated shape according to a respective first longitudinal axis and having indefinite length, comprising an outer casing, a passageway defining a crossing direction to allow the passage of said semi-finished product during operation with said respective longitudinal axis coinciding with said crossing direction, a drum comprising a plurality of treatment lines arranged along a perimeter region of said drum, each of said treatment lines comprising a plurality of units for the treatment of said semi-finished product said units comprising respective cavities which are coaxial and parallel to said crossing direction, each of said units comprising a base to which a respective cover is hinged, each of said cavities comprising a first semi-cavity in said base and a second semi-cavity in said respective cover, each cover being movable between an open position whereto said semi-cavities are separate from each other and a closed position wherein said semi-cavities are near to each other, said drum being accommodated in said casing and rotatable about a second rotation axis parallel to the crossing direction to move each of said treatment lines between an operating position wherein said cavities are aligned with said passageway to be crossed by said semi-finished product, and at least a resting position wherein said cavities are spaced from said passageway, characterized in that said outer casing is shaped in such a way to touch and bold said respective cover in said closed position, each treatment line being in said resting position.

With the present invention it is thus possible to obtain a thermal treatment apparatus in which die treatment units are automatically kept closed when placed in the resting position by effect of conformation of the outer casing. This allows to avoid the manual intervention of an operator to block the closing covers and, consequently, to save time and improve the safety conditions of the line.

The cooling apparatus thus obtained is at the same time characterized by smaller dimensions better distributed with respect to the known cooling apparatuses.

Other advantages of the present invention are obtained by means of a treatment apparatus in accordance with the dependent claims, as explained in greater derail in the description that follows. In particular, the fact that the outer casing further comprises holding means for blocking the covers of the treatment units in the closed position also when these are placed in an operative position, thus allowing to further reduce the manual intervention time of the line operator.

BRIEF DESCRIPTION OF THE DRAWINGS

Further matures and advantages of the present invention will be more apparent in the following detailed description of a preferred embodiment thereof by way of non-exclusive indicative, non-limitative example, with reference to the accompanying drawings, in which.

DETAILED DESCRIPTION OF THE INVENTION

Accompanying FIGS. 1-10 describe a treatment apparatus 1, 1*a*, which may be used to treat a round section bar 10.

Figure 11:
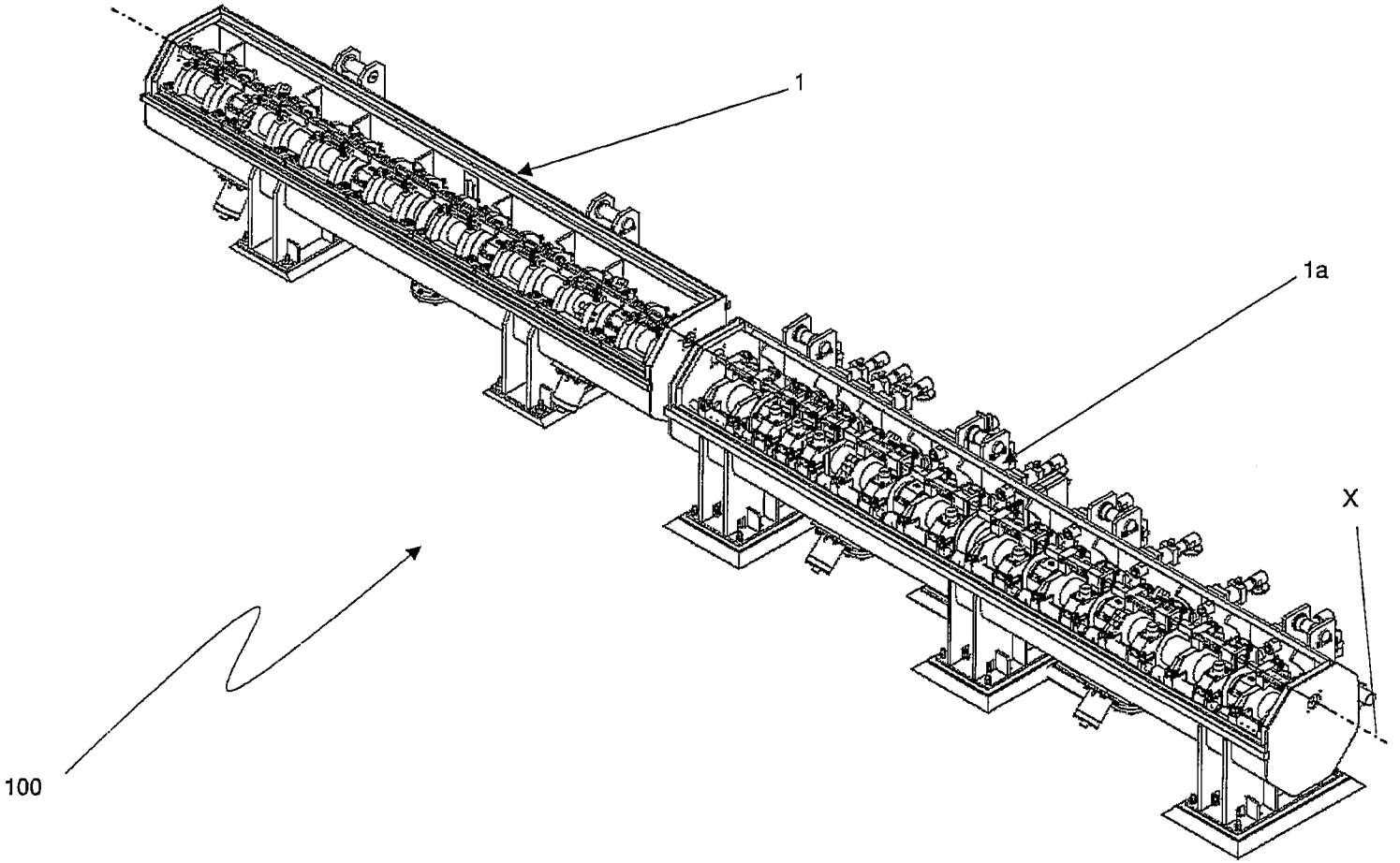
FIG. 11 is an axonometric view of a system comprising a plurality of apparatuses according to the present invention.

With reference to FIG. 11, a system 100 for thermally treating in line a bar 10 comprises two treatment apparatuses 1,1*a* arranged in series for executing respective treatments on the bar 10. In general a system according to the present invention may comprise any number of treatment apparatuses 1,1*a* arranged in series, each of which dedicated, to executing a respective treatment on the bar 10, as described in greater detail below as a function of the desired mechanical and metallurgic features to be conferred to the final product.

According to other embodiment variants of the invention a treatment apparatus according to the present invention can be used to treat, other types of metallurgical semi-finished products having extended elongated shape, such as sections, profiles, beams or other.

In general, a thermal treatment apparatus according to the present invention can be used to treat my metallurgical semi-finished product prevalently extending according to a respective first longitudinal axis Z having indefinite length and any section, e.g. round or polygonal.

The apparatus 1,1*a* comprises an outer casing 3, having nearly cylindrical elongated shape, provided with a plurality of supports 7 (three supports in the embodiment shown in the accompanying figures). A passageway 2 defining a crossing direction X to allow the passage of the bar 10 to be treated through the apparatus 1, 1*a* is created in the casing 3. The casing 3 is provided with a first opening 3*a* for letting the bar 10 into the apparatus 1,1*a* and a second opening 3*b* for letting the oar 10 out from the apparatus 1 at the two respective counterpoised longitudinal ends. The passageway 2 is defined between the openings 3*a,b*, with direction X of crossing orientated from the first to the second opening 3*a, b*.

In operation, the bar 10 is arranged with respective longitudinal, axis Z arranged parallel to the direction of crossing X and moveable so as to travel along the passageway 2 from the first to the second opening 3*a,b*

The apparatus 1,1*a* further comprises a drum 4 accommodated in the casing 3 and rotatable about a second rotation axis Y integral with the casing 3 and fixed with respect thereto. The rotation axis Y is nearly parallel to the crossing axis X and separated therefrom.

The drum 4 is provided with a body 4*a* with nearly cylindrical dimension having an annular perimeter region 5 along which the four treatment line 6 are arranged, distributed about the rotation axis Y. According to the variant embodiments of the accompanying figures, the treatment lines 6 are distributed so that, the angular distance of two adjacent treatment lines 6 with respect to the rotation axis Y is constant and equal to 90°.

In general, according to other variants of the invention (not shown), fewer than four treatment lines (e.g. three cooling lines at angular distances of 120°) or more than four treatment lines (e.g. six cooling lines at angular distances of 60°) may be provided.

Each of the treatment lines 6 has an intrinsically known, conventional conformation, constituted by a sequence of a plurality of treatment units 8, 8*a*, 8*b*, 8*c*, 8*d* arranged in series to be crossed by the bar 10 according to the order defined below with reference to the orientation of the crossing direction X.

Figure 1:
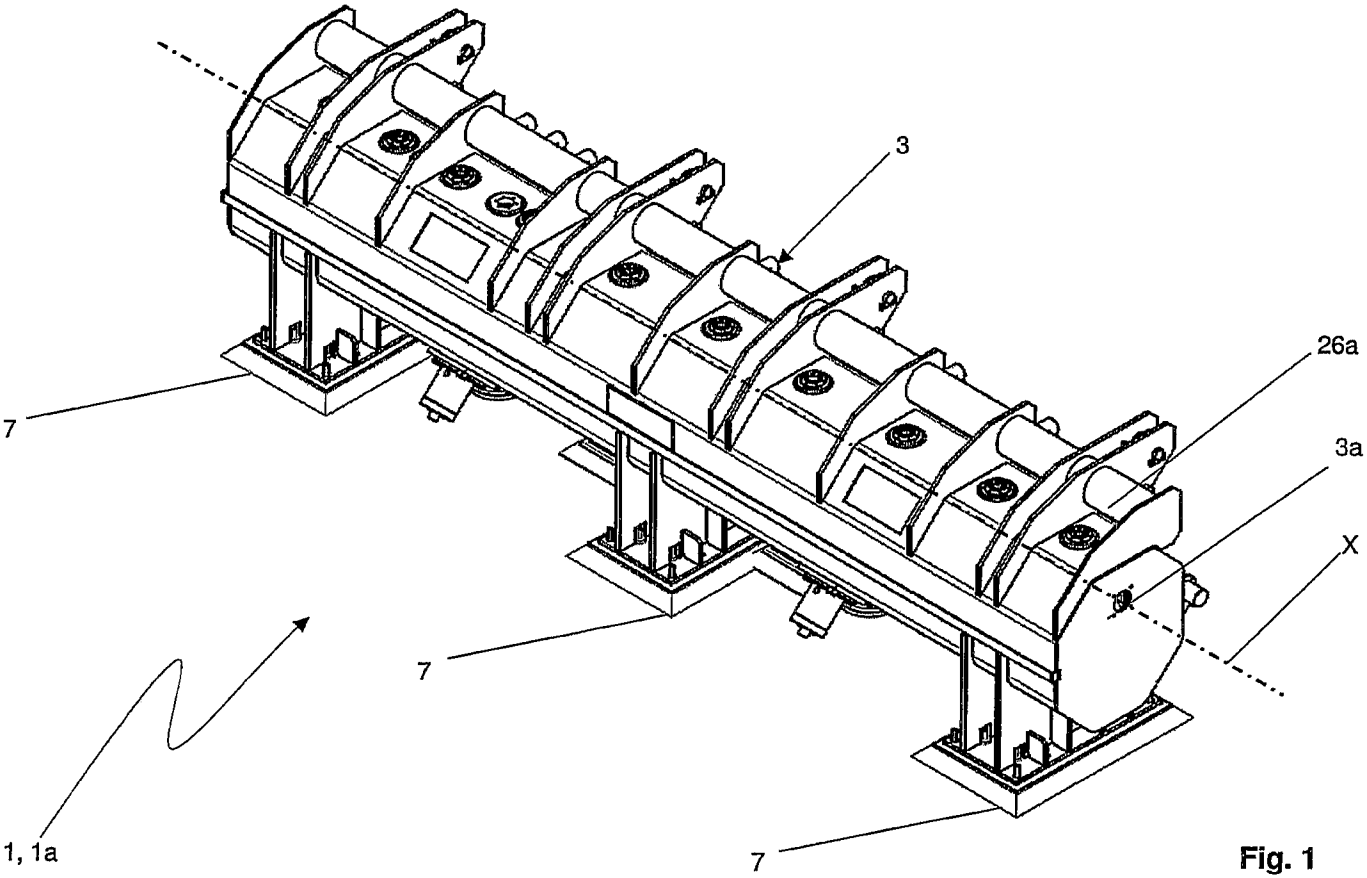
FIG. 1 is an axonometric view of a first embodiment of an apparatus for thermally treating metallurgical semi-finished product in accordance with the present invention.
Figure 2:
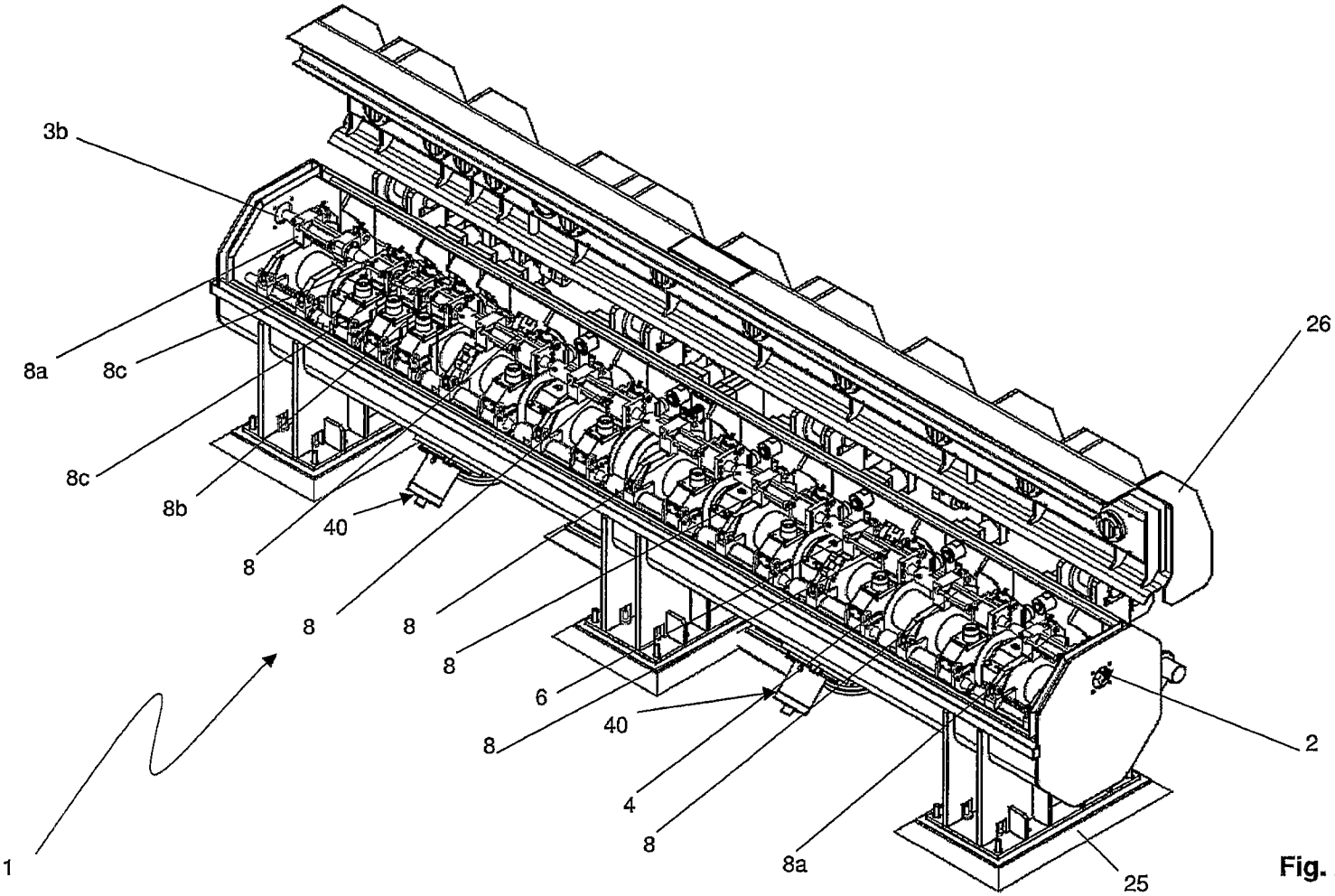
FIG. 2 is an axonometric view of the apparatus in FIG. 1, in a different operating configuration.
Figure 3:
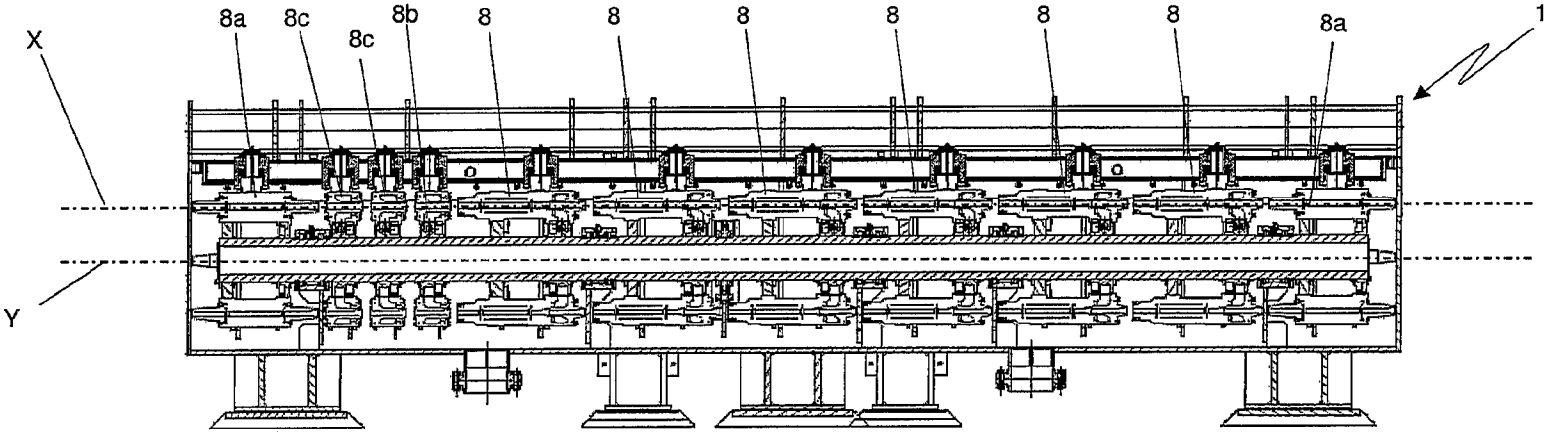
FIG. 3 is a front, section view of the apparatus in FIG. 1.

In accordance with a first embodiment shown in FIGS. 2 and 3, each of the treatment lines 6 comprises an initial guiding unit 8*a*, near the first opening 3*a*, a plurality of intermediate cooling units 8 (six cooling units 8 in the example in FIGS. 2 and 3), and a terminal guiding unit 8*a*, next to the second opening 3*b*. A pressurized cooling fluid is introduced into the cooling units 8 for carrying out a forced thermal cooling treatment on the bar 10, as described in greater detail below. A film of cooling fluid remains on the surface of the bar 10 at the outlet of the cooling units 8, to remove which, a so-called stripper unit 8*b* is provided immediately downstream of the cooling units 8. The same cooling fluid used in the cooling units 8 is introduced in the stripper unit 8*b*, but directed so as to invest the bar 10 countercurrent with respect to the crossing direction, to remove the liquid film present on the surface of the bar 10. A pair of dryer units 8*c* for the final drying of the bar 10 is provided between the stripper unit 8*b* and the final guiding unit 8*a*. Units 8*b* and 8*c* optional and in some variants of the present invention (not shown) treatment lines consisting only of guiding unit 8*a* and cooling unit 8 are provided.

Optionally, according to another variant of the present invention (not shown) the use of treatment lines with a pair of stripper units and one only dryer unit is provided.

Figure 4:
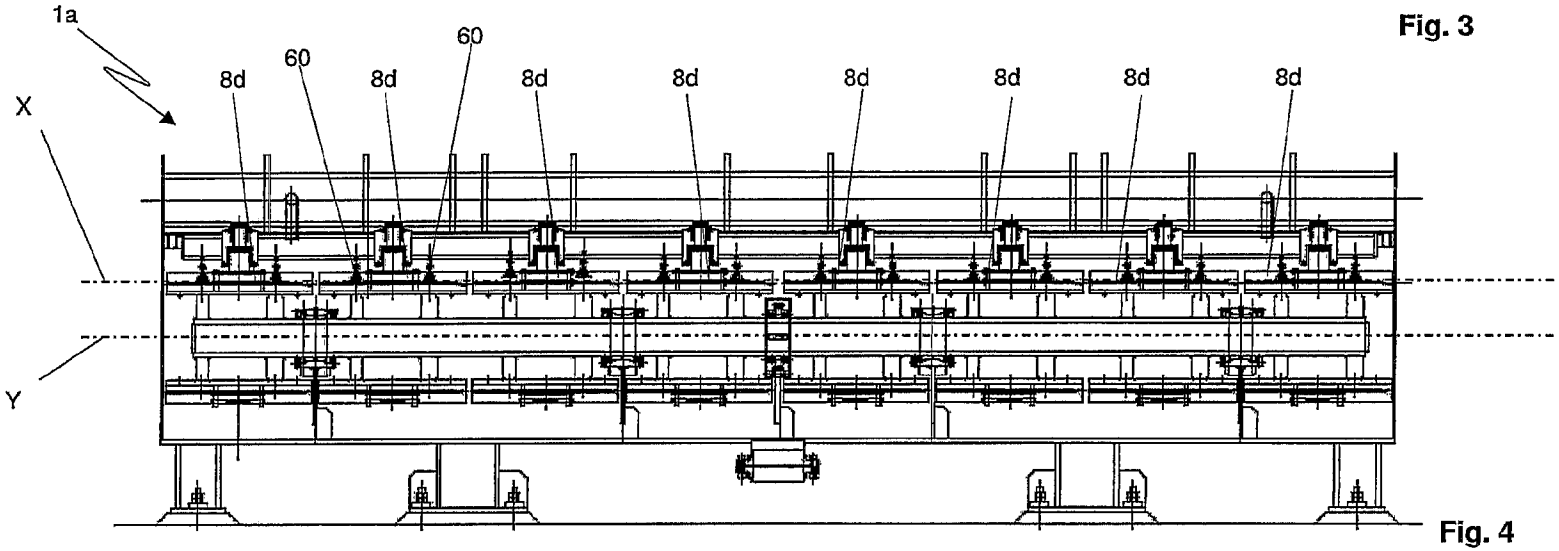
FIG. 4 is a frost section view corresponding to that of FIG. 3 of a second embodiment of the apparatus in accordance with the present invention.
Figure 5:
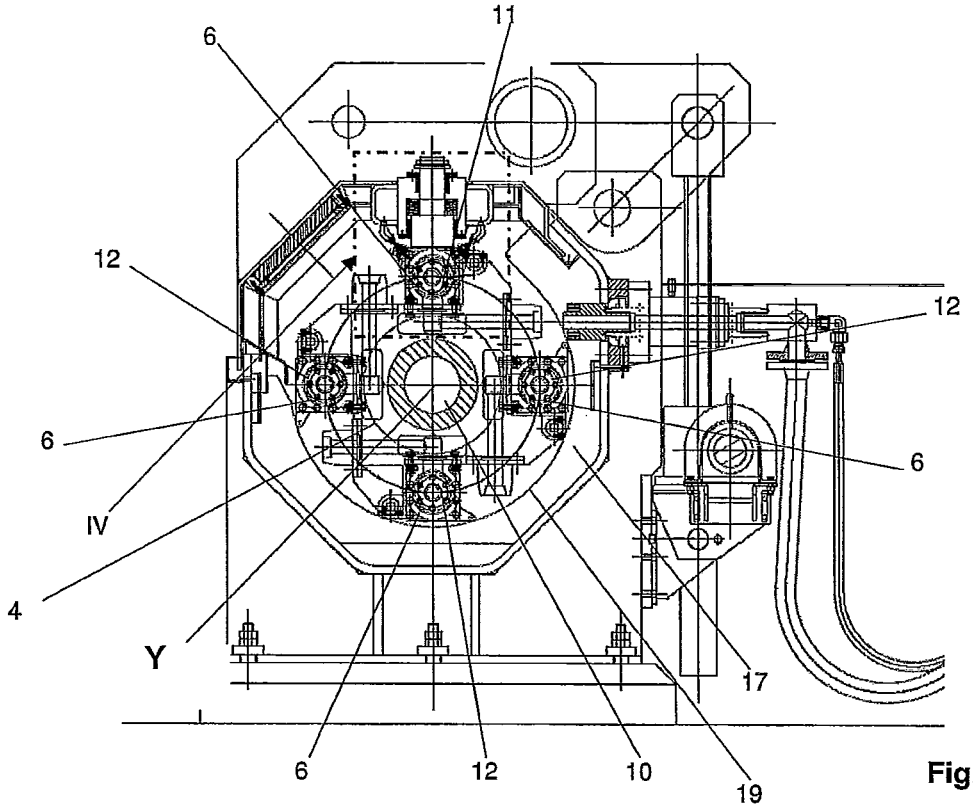
FIG. 5 is a first side section view of the apparatus in FIG. 1.
Figure 9:
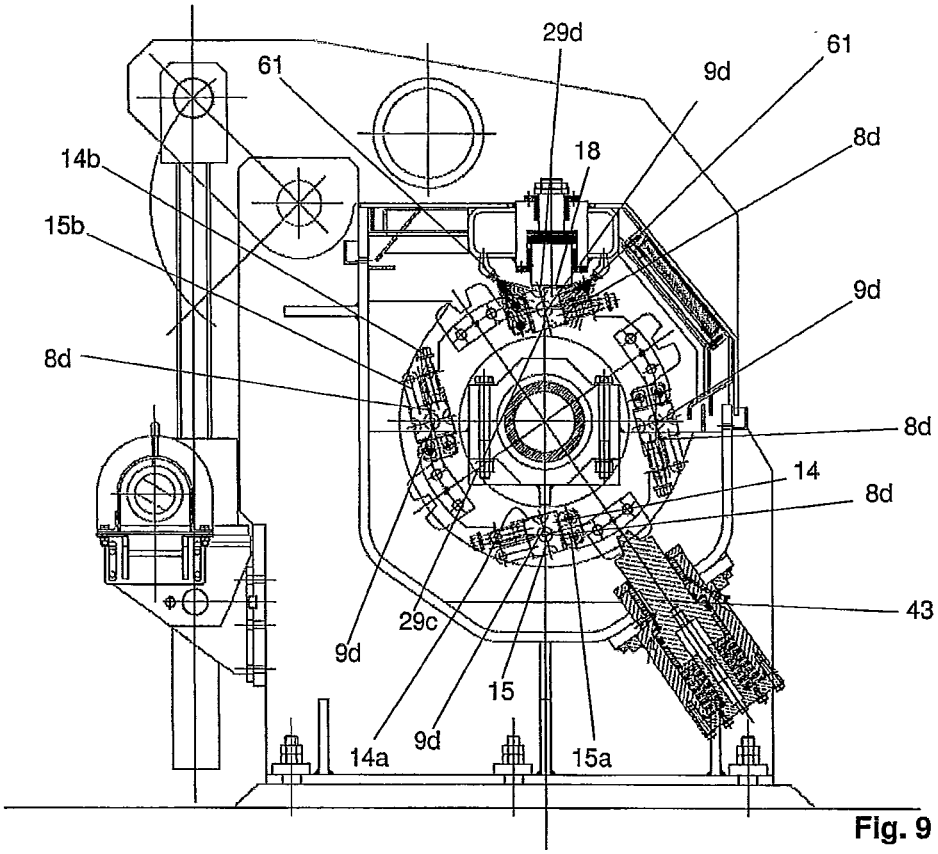
FIG. 9 is a side section view of the apparatus in FIG. 4.
Figure 10:
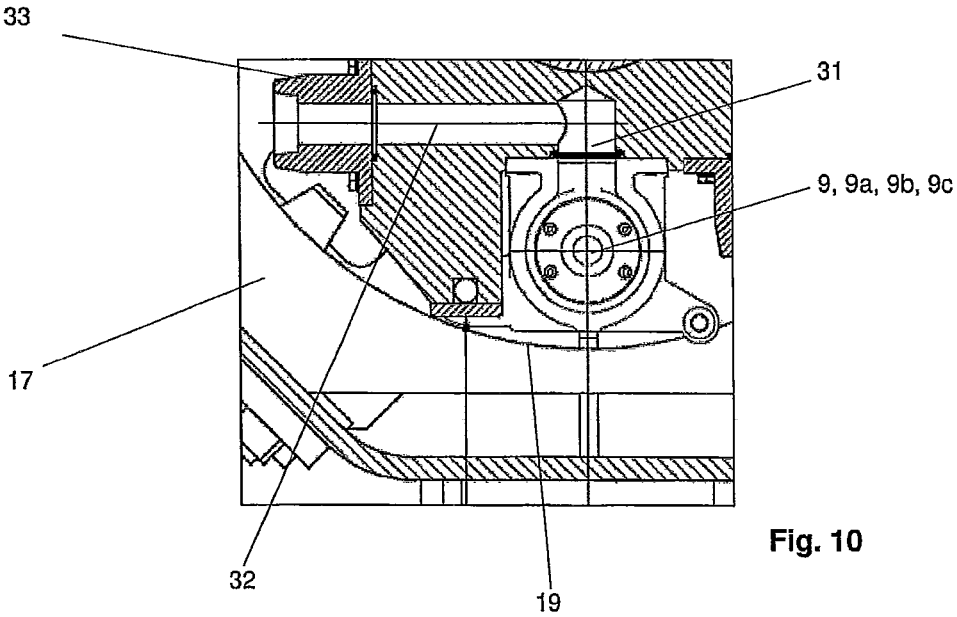
FIG. 10 is an enlarged view of detail VII in FIG. 6.

In accordance with the second embodiment shown in FIGS. 4 and 9, the treatment line 6 of the apparatus 1*a* comprises a plurality of guiding units 8*d* arranged in series with respect to the first and second opening 3*a,b* (eight guiding units 8*d*). In the apparatus 1*a*, the bar 10 is simply guided from the first to the second opening 3*a,b*, without undergoing any forced cooling by means of a cooling fluid but instead by exchanging heat with the guiding units 8*d*, so as to undergo a thermal equalization treatment.

Each of the units 8, 8*a*, 8*b*, 8*c*, 8*d* comprises a respective cylindrical through cavity 9, 9*a*, 9*b*, 9*c*, 9*d* coaxial and parallel to each other along the crossing direction X. The cavities 9*a* of the guiding units 8*a* allow to guide the bar 10 to the inlet and to the outlet of the cooling units 8, respectively. The cavities 9*d* of the guiding units 8*d* allow to guide the bar 10 along the entire path 2 of the apparatus 1*a*. The cavities 9 of the cooling units 8 are arranged to receive the pressurized cooling to cool the bar 10. The cooling fluid placed in contact with the bar 10 in the cavities 9 forms a liquid film on the surface of the bar 10, which must be preferably removed in-line at the end of the cooling treatment. The cavities 9*b* of the stripper unit 8*b* are arranged to receive the cooling fluid in countercurrent with respect to the direction of advancement X, so as to remove the fluid film formed on the surface of the bar 10. In the cavity 9*c* of the dryer unit 8*c* the bar 10 is dried by means of a countercurrent compressed air flow with respect to the direction of advancement X, so as to remove all traces of cooling fluid from the surface of the bar 10.

In the first and second embodiment of the accompanying figures, being the rotation axis Y parallel to the crossing direction X and thus also of the cavities 9, 9*a*, 9*b*, 9*c*, 9*d*, during each rotation of the drum 4 the cavities 9, 9*a*, 9*b*, 9*c*, 9*d* maintain their orientation parallel to the crossing direction X. The drum 4 rotates about rotation axis Y to move each of the treatment lines 6 between an operating position 11, in which the respective cavities 9, 9*a*, 9*b,c* are aligned with the passageway 2 to be crossed by the bar 10, and three resting positions 12, respectively turned by 90°, 180° and 270° with respect to the operating position 11, in which the cavities 9,9*a*, 9*b,c* are separated by the passageway 2.

The operating position 11 faces the opposite part with respect to the supports 7, so that the treatment lines 6 are easily accessible by an operator in operating position.

In order to block the drum 4 in a desired angular position, in which one of the treatment lines 6 is in the operating position 11, the apparatus 1 comprises a blocking device 40, including a pair of hydraulic actuators 43 integral to the outer casing 3 and mutually separated along the crossing direction X and two pluralities of recesses 41 provided on an outer edge surface 5*a* of the perimeter region 5, in position corresponding to the hydraulic actuators 43, respectively. The recesses 41 of each plurality are distributed in intermediate positions between the treatment lines 6, and thus their number is equal to that of the treatment lines 6 (four recesses 41 for each plurality in the examples in the accompanying figures). The recesses 41 are susceptible of being used with a stem 42 of the respective hydraulic actuator 43, when a respective treatment line 6 is in the operating-position 11. The hydraulic actuators 43 are fitted on the outer casing 3 in position angularly separated with respect to the operating position 11 and the resting positions 12 in order to allow the coupling between each recess 41 and the respective stem 42, when a respective treatment line 6 is in the operating position 11.

Figure 6:
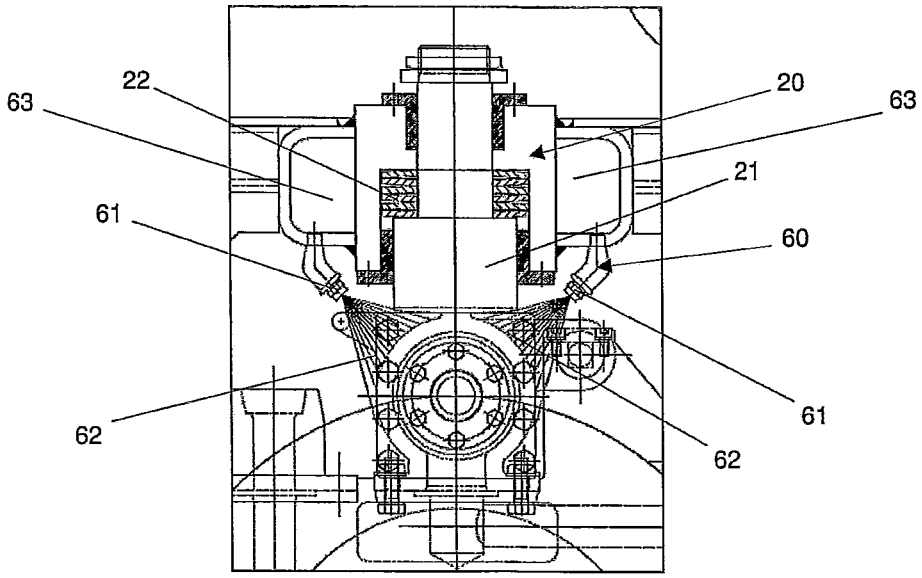
FIG. 6 is an enlarged view of detail IV in FIG. 3.
Figure 7:
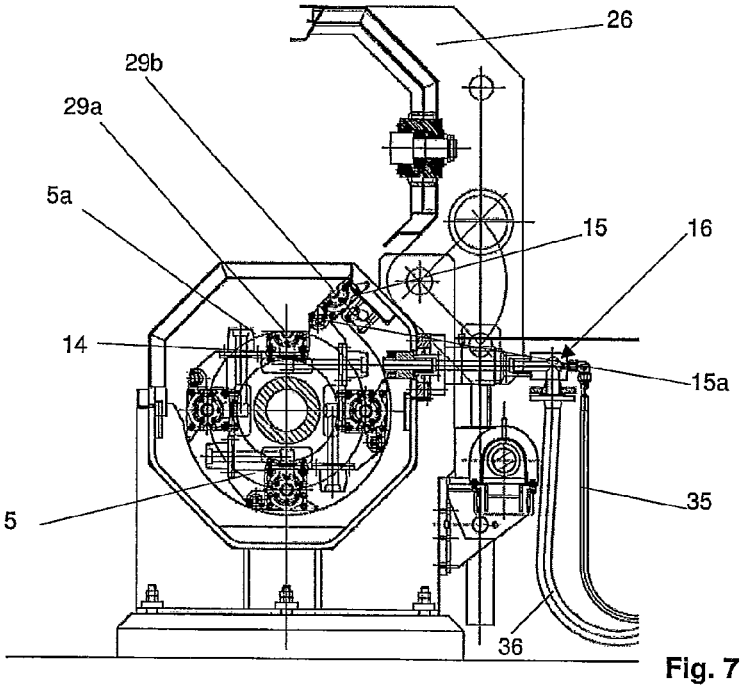
FIG. 7 is a side section view of the apparatus in FIG. 1, in the operating configuration in FIG. 2.
Figure 8:
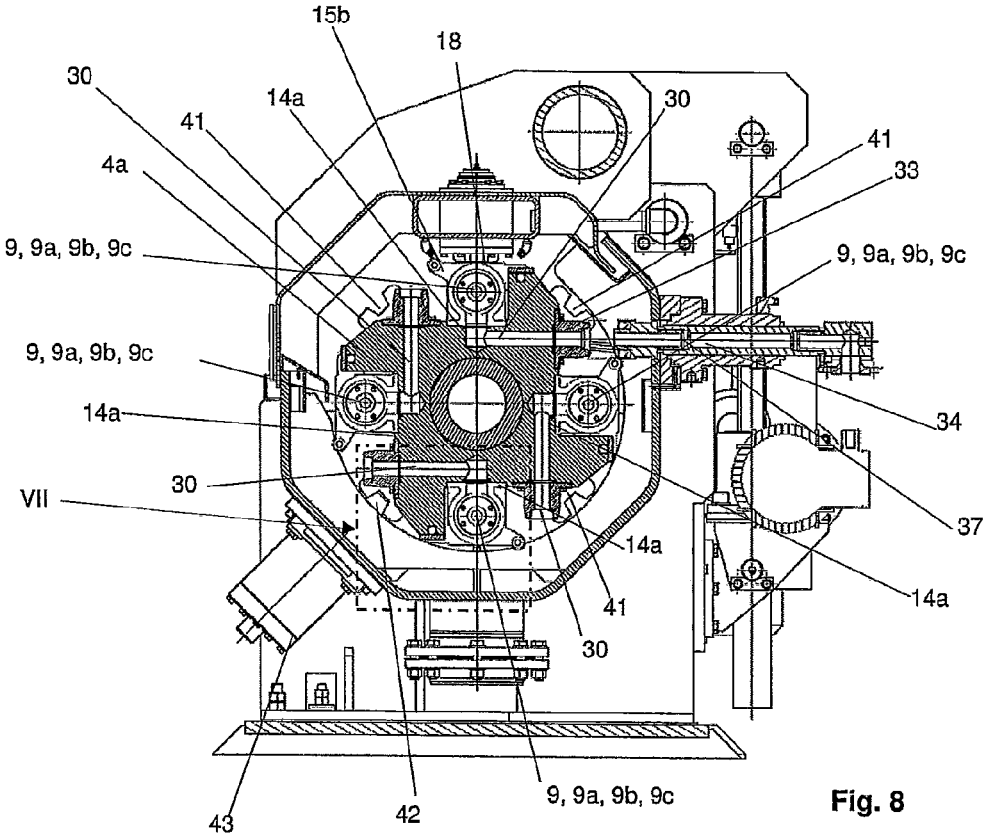
FIG. 8 is a second side section view of the apparatus in FIG. 1.

The stem 42 can be translated from a retracted position, within the respective actuator 43, in which the drum 4 is free to turn about the rotation axis Y, to an extended position, in which the stem 42 can be coupled with one of the recesses 41 (FIG. 6).

In the variants described above, in the case of three cooling units there are two resting positions, turned by 120° and 240° with respect to the operating position respectively, while in the case of six cooling units there are live resting positions turned by 60°, 120°, 180°, 240° and 300° with respect to the operating position respectively.

The cavities 9, 9*a*, 9*b*, 9*c*, 9*d* are dimensioned so that the passage of the bar 10 is allowed through the respective cavities 9, 9*a*, 9*b*, 9*c*, 9*d* when the treatment line 6 is in the operating position 11. The passageway 2 thus consists of a plurality of cavities 9, 9*a*, 9*b*, 9*c*, 9*d* belonging to a same treatment line 6 placed in operating position 11 so as to be crossed in series, according to the order defined above, by a same bar 10. The cavities 9, 9*a*, 9*b*, 9*c*, 9*d* of a same treatment line are characterized in that they have the same diameter.

The diameter of the bar 10 is smaller than that of the cavities 9, 9*a*, 9*b*, 9*c*, 9*d* so that there is a given clearance, variable as a function of the diameter of the bar 10, between the bar 10 and the cavities 9, 9*a*, 9*b*, 9*c*, 9*d* in operation. Each treatment line 6 can indeed be used with different bar diameters.

The cavities 9, 9*a*, 9*b*, 9*c*, 9*d* of each treatment line 6 differ from those of the other treatment lines 6 for their size, so as allow the treatment on a wide range of diameters, e.g. from 3.6 mm to 25 mm.

Each of the units 8, 8*a*, 8*b*, 8*c*, 8*d* is advantageously made in two opening halves 14, 15, constituted by a base 14, accommodated in a respective seat 14*a* obtained in the body 4*a* of the drum 4, and by a cover 15 hinged to the base 14 at a respective hinge 15*a*.

Each of the cavities 9, 9*a*, 9*b*, 9*c*, 9*d* comprise a respective semi-cavity 29*a* obtained in the base 14 and a second semi-cavity 29*b* obtained in the cover 15 of the respective treatment unit 8, 8*a*, 8*b*, 8*c*, 8*d*.

Each cover 15 can be manually moved by means of a respective handle 15*b*, to be turned about the hinge 15*a* between an open position in which the respective cavity 9, 9*a*, 9*b*, 9*c*, 9*d* can be accessed and a closed position in which the cover 15 is in contact with the respective base.

In the open position, the two semi-cavities 29*a,b* are mutually separate so as to be accessible for cleaning or maintenance, e.g. for removing scale which is accumulated during advancement of the bar 10. Furthermore, it advantageously allows to remove eventual cobbled bars with considerable rapidity.

In the closed position, the two semi-cavities 29*a,b* of each unit 8, 8*a*, 8*b*, 8*c*, 8*d* are arranged near to each other so as to form the respective cavity 9, 9*a*, 9*b*, 9*c*, 9*d*, in the second embodiment in FIGS. 4 and 9, the bases 14 and the covers 15 of the guiding unit 8*d* respectively comprise a third and fourth semi-cavity 29*c,d*, respectively obtained on the outer sides of the bases 14 and the covers 15, counterpoised with respect to the respective semi-cavity 29*a,b*. This allows to arrange a second pair of semi-cavities 29*c,d* useable with the same purposes instead of the semi-cavities 29*a,b* when these are worn. This is ensured by the symmetric conformation of the guiding unit 8*d*, it is possible to arrange the semi-cavities 29*c,d* near to each other, so as to form one of the cavities 9*d*, by means of 180° rotation about the hinge 15*a*.

Advantageously, the seats 14*a* are machine-tooled surfaces and allow a considerable positioning accuracy of the units 8, 8*a*, 8*b*, 8*c*, 8*d* during assembly and consequently an accurate alignment of the respective cavities 9, 9*a*, 9*b*, 9*c*. The alignment accuracy is in the order of ±0.1 mm and is maintained such over time because the units 8, 8*a*, 8*b*, 8*c*, 8*d* do not need to be disassembled and refitted at each change of production, the line change by means of rotation of the drum being sufficient. Such an accurate alignment guarantees the absence of cobbling of the bar during its passage also at very high speed within the treatment units.

In the second embodiment, the coupling between the base 14 and the respective seat 14*a* is obtained by means of friction between the bars obtained by means of a respective screw 14*b*, arranged laterally to the respective guiding unit 8*d*, which can be screwed to push the base 14 against the respective seat 14*a*. Such a coupling allows to rapidly couple and uncouple the guiding units 8*d*, e.g. to allow the rotation 180° about the hinge 15*a* and the consequently to replace the semi-cavities 29*a,b* with the semi-cavities 29*c,d*.

In the first embodiment the apparatus 1 further comprises a cooling circuit 16 which can be connected to each of the cooling units 8 when this is in the operating position 11, to sent a cooling fluid, e.g. pressurized water, towards a respective cavity 9, 9*c*. The circuit in comprises a plurality of pipes 30 obtained in the body 4*a* of the drum 4, connected respectively to the cavities 9, 9*c*.

Each pipe 30 comprises a first radial segment 31 connected to the cavity 9, 9*c* and radially extending towards the rotation axis Y of the drum 4 and a second segment 32 orthogonal to the first segment 31, connecting the first, segment 31 and a fitting 33 protruding from the edge surface 3*a* of the perimeter region 5. Each second segment 32 is oriented so as to be arranged according to it horizontal direction when the cooling unit 8 comprising the respective cavity 9 connected thereto is arranged in the operating position 11. In such a condition, the fitting 33 faces and is aligned with respect to a hydraulic coupling 34, also horizontal, outer with respect to the drum 4 and connected, by means of a flexible tube 36, to a source (not shown) of cooling fluid. The hydraulic coupling 34 can move along its approach and distancing axis with respect to the fitting 33 to respectively couple and uncouple on the fitting 33. Advantageously, this can be obtained by means of an automatic actuation when the respective cooling unit 8 is in the operating position so as to respectively connect and disconnect the respective cavity 9 and the fluid source. When the hydraulic coupling 34 is coupled onto the fitting 33 the cooling fluid may be sent to the respective cavity 9 when this is crossed by the bar 10 to cool it.

The cooling circuit 16 thus made allows to selectively connect each of the cavities 9 to the cooling fluid source maintaining the rotation axis Y fixed and integral with the outer casing 3.

The hydraulic coupling 34 is further connected also to a flexible tube 35 for introducing gaseous fluid, e.g. air. Advantageously, after the passage of a bar and before the passage of the next bar a jet of air is injected into the cooling unit 8 in order to eliminate the residual cooling fluid from the respective cavity 9.

As a function of the desired mechanical properties and metallurgic features to be conferred to the final product, it is possible to selectively disconnect some of the cavities 9 from the cooling fluid source, in such a condition, the cooling fluid is not sent to the respective flexible tube 36 because if is intercepted upstream by a pneumatic valve (not shown) and the cavity 9 is disconnected from the source of cooling fluid by disconnecting the respective hydraulic coupling 34.

When the cavity 9 crossed by the bar 10 is disconnected from the source of the cooling fluid, the respective cooling unit 8 tends to heat up by effect of the heat surrendered by the bar 10 during its passage. In order to avoid she overheating of the cooling units 8 disconnected from the source of cooling fluid a plurality of spray cooling devices 60, separated along the advancement axis X and connected to the cooling circuit 16, are advantageously provided. Each spray cooling device 60 comprises a pair of nobles hi for each cooling unit 8. The nozzles 61 are connected and integral with a manifold 63 provided on the casing 3, arranged symmetrically with respect to a vertical plane comprising the direction of advancement X and facing towards the cooling unit 8 so as to invest it externally with two counterpoised jets 62 of cooling fluid. The jets 62 are both inclined by an angle of approximately 45° with respect to the vertical plane comprising the direction of advancement X.

In the second embodiment in FIGS. 4 and 9, because a thermal equalization treatment is carried out in the cavities 9*d* of the guiding unit 8*d* which does not require the contribution of cooling fluid, a pair of spray cooling devices 60, placed in respective positions separated along the advancement axis X and operatively active when the bar 10 crosses the apparatus 1*a*, is provided to avoid the overheating of the guiding units 8*d*.

In all the embodiments, the casing 3 comprises a first fixed portion 25, to which the drum 4 is rotationally coupled so as to rotate about the rotation axis Y, and a second portion 26, mobile with respect to the fixed position 25, about a hinge 26*a*. Use rotation of the second portion 26 about the hinge 26*a* allows to open the casing 3 so as to access the drum 4, e.g. to allow maintenance and cleaning operations of each treatment line 6 when this is placed in the operating position 11. During the treatment operations of the bar 10, the second mobile portion 26 is lowered and in contact with the fixed position 25, so as to keep the outer casing 3 closed.

The fixed portion 25 of the casing 3 is shaped so as to touch and hold the cover 15 in the closed position when the cooling units 8 are in resting position.

Such a condition is obtained by means of a ribwork 17 provided on the fixed portion 25 of the outer casing 3 and protruding from an inner surface 35 of the fixed portion 25, facing towards the drum 4. The ribwork 17 is transversal with respect to the rotation axis Y and comprises a free edge 19, separated from the inner surface 35, shaped so as to touch and hold the covers 15 in the closed position when the treatment units 8, 8*a*, 8*b*, 8*c*, 8*d* are in the resting position. Therefore, the ribwork 17 allows to advantageously withhold the covers 15 of the treatment units 8, 8*a*, 8*b*, 8*c*, 8*d* in the respective closed position in automatic manner when they are in one of the resting position 12.

In the second embodiment in FIGS. 4 and 9, the handle 15*b* of each cover 15 is shaped so as to touch the ribwork 17 when the respective treatment unit 8, 8*a*, 8*b*, 8*c*, 8*d* is in one of the resting positions 12.

According to other variants of the invention (not shown), such a condition may be obtained also in different manners, e.g. by means of respective touching elements protruding from the inner surface of the casing 35 at each resting portion of the cooling units 8.

In general, for the purposes of the present invention, other outer casings of different conformation can be used, providing they are capable of touching and holding the covers 15 in the closed position when the cooling units 8 are in the resting position.

The casing 3 further comprises elastic holding means 20 provided on the mobile portion 26, adapted to hold the covers 15 in the closed position, when each cooling line 6 is in the operating position 11.

In both examples shown in the accompanying figures, the holding means 20 comprise a plurality of blocking brackets 21 cooperating with a touching surface 18 provided on the covers 15 to hold them in closed position when the respective holding unit 8, 8*a*, 8*b*, 8*c*, 8*d* is in the operating position 11 and the outer casing 3 is closed with the mobile part 26 near the fixed part 25. The holding means 20 further comprise a pack of Belleville washers 22 interposed between the bracket 21 itself and the mobile portion 26 of the casing 3 for each blocking bracket 21. The pack of Belleville washers 22 is dimensioned and arranged so that they are compressed when, the mobile portion 26 is near the fixed portion 25, so that each blocking bracket 21 is pressed against the respective cover 15, maintaining it closed against the respective base 14.

According to the other variants of the invention (not shown), instead of the Belleville washers 22, other types of elastic contrast elements can be used, e.g. helical springs, providing they can press the respective blocking bracket 21 against the respective cover 15.

According to further embodiments of the invention (not shown), the holding means 20 comprise a plurality of hydraulic actuators, active on the covers 15, respectively, instead of the plurality of brackets 21.

In the second embodiment in FIGS. 4 and 9, on each of the guiding units 8*d* the touching surface 18 is arranged by the side of the semi-cavity 29*d* provided on the outer side of the cover 15, so as not to damage the semi-cavity 29*d* when the bracket 21 presses on the respective cover 15.

The described technical solutions allow to fully satisfy the predetermined task, and objects with reference to the known prior art, obtaining a plurality of advantages, in particular the replacement of a plurality of manual operations with respective automatic operations.

The invention claimed is:

1. An apparatus for thermally treating a metallurgical semi-finished product having extended elongated shape according to a respective first longitudinal axis and having indefinite length, comprising:

an outer casing, a passageway defining a crossing direction to allow the passage of said semi-finished product during operation with said respective longitudinal axis coinciding with said crossing direction, a drum comprising a plurality of treatment lines arranged along a perimeter region of said drum, each of said treatment lines comprising a plurality of units for the treatment of said semi-finished product, said units comprising respective cavities which are coaxial and parallel to said crossing direction, each of said units comprising a base which a respective cover is hinged to, each of said cavities comprising a first semi-cavity in said base and a second semi-cavity in said respective cover, each cover being movable between an open position wherein said semi-cavities are separate from each other and a closed position wherein said semi-cavities are near to each other, said drum being accommodated in said casing and rotatable about a second rotation axis parallel to the crossing direction to move each of said treatment lines between an operating position wherein said cavities are aligned with said passageway to be crossed by said semi-finished product, and at least a resting position wherein said cavities are separated from said passageway, characterized in that said outer casing is shaped in such a way as to touch and hold said respective cover in said closed position, when each treatment line is in said resting position.

2. An apparatus according to claim 1, wherein said apparatus comprises a cooling circuit which is connectable to the treatment units, when each of said treatment lines is in said operating position for sending a cooling fluid into said respective cavity.

3. An apparatus according to claim 1, wherein said outer casing comprises a transversal ribwork with respect to said rotation axis, said ribwork comprising an edge shaped in such a way as to touch and hold said respective cover in said closed position, when each of said treatment lines is in said resting position.

4. An apparatus according to claim 1, wherein said rotation axis of said drum is fixed with respect to said casing (3).

5. An apparatus according to claim 1, wherein said apparatus comprises a blocking device for blocking the rotation of said drum and holding each of said treatment lines in said operating or resting positions.

6. An apparatus according to claim 1, wherein said casing comprises holding means adapted to hold said respective cover in said closed position, when each of said treatment lines is in said operating position.

7. An apparatus according to claim 1, wherein said casing comprises a first fixed portion and a second movable portion (26) with respect to said portion, to allow the access to said drum, said holding means being provided on said movable portion of said casing.

8. An apparatus according to claim 1, wherein said plurality of treatment lines is distributed within said perimeter area of said drum in such a way that the angular distance between the two adjacent treatment lines is constant with respect to the axis.

9. An apparatus according to claim 1, wherein said treatment lines of said drum differ from each other in shape and/or size of the respective cavities so as to allow the passage of the respective metallurgical semi-finished products, which differ from each other in shape and/or size.

10. A system comprising a plurality of apparatuses according to claim 1.

11. A system according to the preceding claim 10, said system comprising at least a first apparatus of said plurality of apparatuses and at least a second apparatus of said plurality of apparatuses, said first and second apparatus being crossable in series by said semi-finished product, said first apparatus being connected to said cooling circuit and said second apparatus being isolated with respect to said cooling circuit.

* * * * *